US007237706B2

(12) United States Patent
Vought

(10) Patent No.: US 7,237,706 B2
(45) Date of Patent: Jul. 3, 2007

(54) DROP HAMMER

(75) Inventor: Michael L. Vought, Grove City, MN (US)

(73) Assignee: Clark Equipment Company, Montvale, NJ (US)

( * ) Notice: Subject to any disclaimer, the term of this patent is extended or adjusted under 35 U.S.C. 154(b) by 0 days.

(21) Appl. No.: 11/043,422

(22) Filed: Jan. 26, 2005

(65) Prior Publication Data

US 2005/0189128 A1 Sep. 1, 2005

Related U.S. Application Data

(60) Provisional application No. 60/539,952, filed on Jan. 29, 2004.

(51) Int. Cl.

| | |
|---|---|
| ***B21J 7/06*** | (2006.01) |
| ***B21J 7/08*** | (2006.01) |
| ***B21J 7/28*** | (2006.01) |
| *B21J 13/08* | (2006.01) |

(52) U.S. Cl. ..... 227/52; 227/62

(58) Field of Classification Search ..... 227/112, 227/52, 62; 173/19, 32, 34, 51, 81, 124, 173/184

See application file for complete search history.

(56) References Cited

U.S. PATENT DOCUMENTS

| | | | | |
|---|---|---|---|---|
| 1,677,422 A | | 7/1928 | Abram | |
| 1,714,345 A | | 5/1929 | Brennan et al. | |
| 1,731,576 A | * | 10/1929 | Jackson | 173/51 |
| 2,659,583 A | | 11/1953 | Dorkins | 262/13 |

(Continued)

FOREIGN PATENT DOCUMENTS

DE 195 37 890 A1 10/1995

(Continued)

OTHER PUBLICATIONS

International Preliminary Report on Patentability and Written Opinion for International Application No. PCT/US2005/002498 filed Jan. 26, 2005. Date of mailing Nov. 9, 2006.

*Primary Examiner*—Louis K. Huynh
*Assistant Examiner*—Nathaniel Chukwurah
(74) *Attorney, Agent, or Firm*—Michael Best & Friedrich LLP

(57) ABSTRACT

Embodiments of the present invention pertain to a drop hammer comprising a load, an actuator connected to the load, and a fluid circuit that is connected to the actuator and is connectable to a fluid source, such as a source of hydraulic power. The fluid circuit is operable with differential pressure to displace the load. The fluid circuit includes a slow-release device for releasing differential pressure, thereby slowly displacing the load as a function of flow from the fluid source. Embodiments of the present invention also pertain to a drop hammer comprising a frame, a selectively actuated rotatable sprocket mounted on the frame, a hammer implement, and at least one chain engaged by the sprocket. The chain includes two-pitch link that includes a catch between two pitched wings, the catch being configured for engaging the hammer implement, enabling the first chain to displace the hammer implement. Other embodiments pertain to a drop hammer that includes a frame and a selectively actuated hammer implement displaceably mounted on the frame. The hammer implement includes a collar surrounding an impact tool.

20 Claims, 6 Drawing Sheets

U.S. PATENT DOCUMENTS

| | | | | | |
|---|---|---|---|---|---|
| 2,844,006 | A | | 7/1958 | Lutz et al. | 61/73 |
| 3,205,952 | A | | 9/1965 | Sicotte | |
| 3,216,511 | A | * | 11/1965 | Ladd et al. | 173/19 |
| 3,253,860 | A | * | 5/1966 | Shapiro | 297/174 CS |
| 3,369,616 | A | * | 2/1968 | McGonigal et al. | 173/124 |
| 3,543,868 | A | | 12/1970 | Drake | 173/21 |
| 3,566,668 | A | * | 3/1971 | Browning et al. | 73/12.13 |
| 3,658,139 | A | | 4/1972 | Von Ruden | 173/124 |
| 3,700,047 | A | | 10/1972 | Gartner | 173/124 |
| 3,783,953 | A | | 1/1974 | Kopaska | 173/23 |
| 3,819,144 | A | | 6/1974 | Hatlevoll et al. | 299/37 |
| 3,934,655 | A | | 1/1976 | Whistle | 173/46 |
| 3,986,566 | A | | 10/1976 | Hamilton | 173/31 |
| 4,005,944 | A | | 2/1977 | Harris | 404/133 |
| 4,124,081 | A | | 11/1978 | Deike | 173/28 |
| 4,356,871 | A | * | 11/1982 | Fujikawa | 173/8 |
| 4,429,751 | A | * | 2/1984 | Jackson et al. | 173/13 |
| 4,440,236 | A | * | 4/1984 | Shiihara et al. | 173/8 |
| 4,601,352 | A | | 7/1986 | Hamilton | 173/24 |
| 4,634,311 | A | | 1/1987 | Jinnings et al. | 404/90 |
| 4,838,363 | A | | 6/1989 | MacOnochie | 173/139 |
| 4,852,662 | A | | 8/1989 | Bianchi et al. | 173/119 |
| 4,889,192 | A | | 12/1989 | Ricard | 173/22 |
| 4,977,965 | A | * | 12/1990 | Rupe | 173/81 |
| 5,012,873 | A | | 5/1991 | Kennedy et al. | 173/53 |
| 5,299,857 | A | | 4/1994 | Zanetis | 404/90 |
| 5,490,740 | A | | 2/1996 | Johnson | 299/37.4 |
| 5,529,132 | A | | 6/1996 | Evarts | 173/1 |
| 5,896,936 | A | * | 4/1999 | Hakkinen et al. | 173/193 |
| 6,003,619 | A | * | 12/1999 | Lange | 173/184 |
| 6,439,317 | B1 | * | 8/2002 | Minotti et al. | 173/89 |

FOREIGN PATENT DOCUMENTS

| | | |
|---|---|---|
| EP | 0 569 339 A1 | 5/1993 |
| EP | 569339 | 11/1993 |
| NZ | 174807 | 5/1983 |
| NZ | 236584 | 10/1990 |
| WO | WO 02/22965 | 3/2002 |
| WO | WO 02/22965 A1 | 3/2002 |

* cited by examiner

DROP HAMMER

CROSS-REFERENCE TO RELATED APPLICATION

The present application is based on and claims the benefit of U.S. provisional patent application Ser. No. 60/539,952, entitled "DROP HAMMER", filed Jan. 29, 2004, the content of which is hereby incorporated by reference in its entirety.

SUMMARY OF THE INVENTION

One aspect of the present invention pertains to a drop hammer comprising a load, an actuator connected to the load, and a fluid circuit that is connected to the actuator and is connectable to a fluid source, such as a source of hydraulic power. The fluid circuit is operable with differential pressure to displace the load. The fluid circuit includes a slow-release device for selectively releasing differential pressure, thereby slowly displacing the load as a function of flow from the fluid source.

Another aspect of the present invention pertains to a drop hammer comprising a frame, a selectively actuated rotatable sprocket mounted on the frame, a hammer implement, and at least one chain engaged by the sprocket. The chain includes two-pitch link that includes a catch between two pitched wings, the catch being configured for engaging the hammer implement, enabling the first chain to displace the hammer implement.

Another aspect of the present invention pertains to a frame and a selectively actuated hammer implement displaceably mounted on the frame. The hammer implement includes a collar surrounding an impact tool.

Additional objects, features, and advantages of the present invention may be discerned through the corresponding description and figures, and inferred by those in the art from the general teaching of the present disclosure and in the course of practicing, manufacturing, using, and otherwise experiencing different embodiments, incorporating the present invention.

DETAILED DESCRIPTION OF ILLUSTRATIVE EMBODIMENTS

Figure 1:
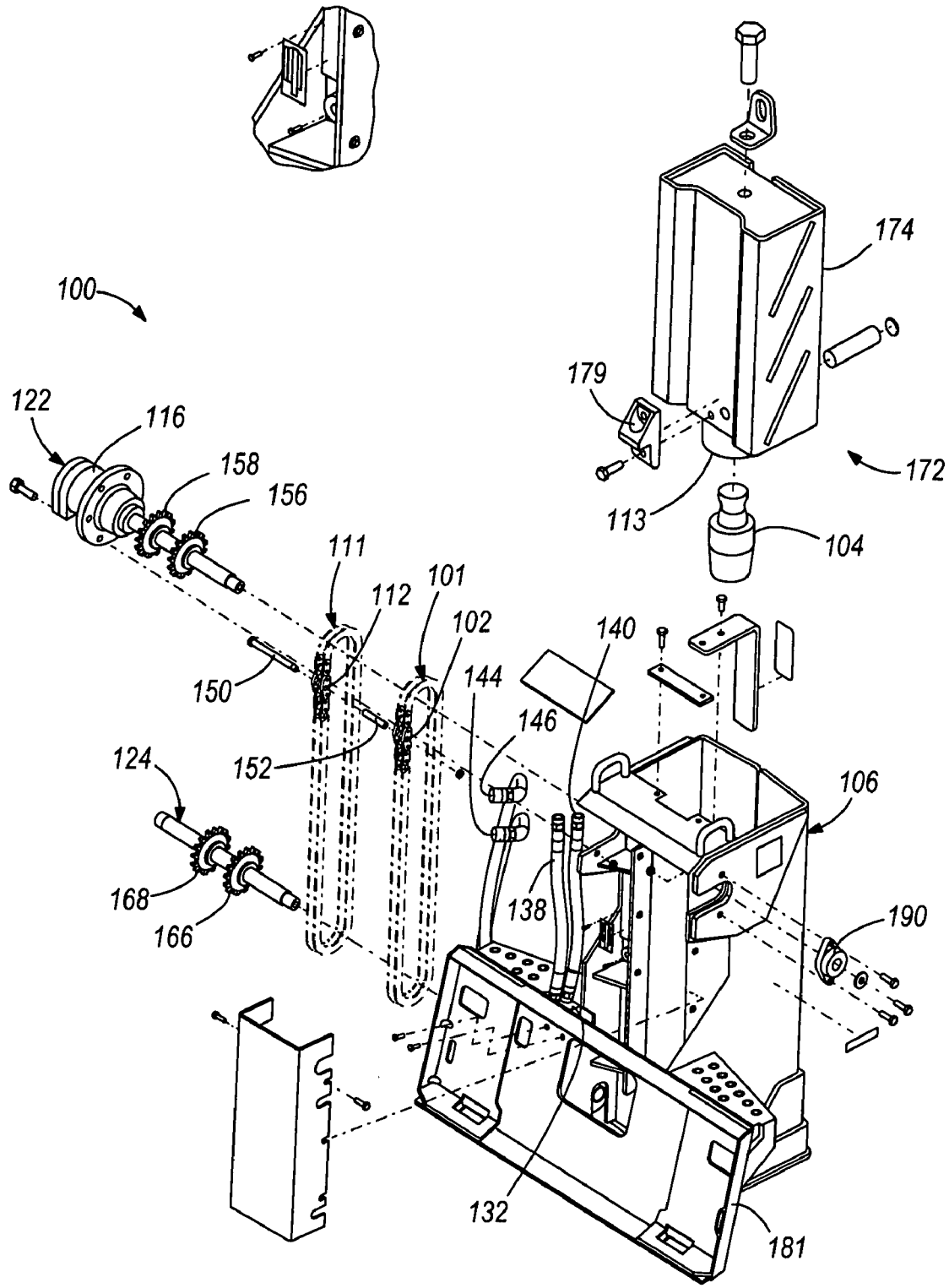
FIG. 1 is an exploded, perspective view of a drop hammer including a hydraulic circuit having a slow-release device, a pair of chains with two-pitch links, and a hammer implement having a hammer collar, according to one embodiment.

FIG. 1 is an exploded, perspective view of a drop hammer 100, according to one embodiment of the present invention. Drop hammer 100 is useful for impacting a surface, such as a concrete sidewalk for example, with significant force and momentum by repeatedly dropping hammer implement 172 onto the surface.

Drop hammer 100 includes hammer frame 106, within which hammer implement 172 is slidably received. Motorized sprocket assembly 122 and free sprocket assembly 124 are rotatably mounted on frame 106, proximate to its top and bottom, respectively. Sprocket shafts 122 and 124 engage chains 101 and 111, which include two-pitch links 102 and 112, from which hammer pin 150 is suspended.

Hydraulic lines 144, 146 are fluidly coupled to hydraulic circuit 132, which is fluidly coupled via hydraulic lines 138, 140 to motor 116. Hydraulic circuit 132 is one example of a fluid circuit that may be used in the present invention. Motor 116 drives motorized sprocket assembly 122, and thereby chains 101 and 112. Hammer pin 150 catches hold of hammer latch 179 and is driven to lift hammer implement 172 by hammer latch 179, causing hammer implement 172 to be repeatedly lifted and then dropped within frame 106. Hammer pin 150 is one illustrative form of a catch included on two-pitch link 102 and configured for engaging hammer implement 172. Hammer implement 172 includes impact tool 104, surrounded by hammer collar 113 and fixed to hammer weight 174. When hammer implement 172 is dropped, it may impact a surface beneath it with significant momentum.

Hydraulic line 144 is a pump input line, while hydraulic line 146 is a return line. Lines 144 and 146 are intended to be fluidly coupled to the remainder of a typical hydraulic system, including components such as a pump and a valve block (not depicted in FIG. 1). Such a typical hydraulic system is often advantageously self-contained within a power machine such as a loader, as is very familiar to those skilled in the art of hydraulic systems. Frame 106 is fixed to attachment plate 181, which is configured for attachment to a corresponding attachment plate on the end of the boom of a loader, in this embodiment. Other modes of attachment to other types of hydraulic systems, as well as free-standing units, occur in various alternative embodiments.

Chain 101 includes two-pitch link 102, while chain 111 includes two-pitch link 112. Two-pitch links 102, 112 are adapted to receive hammer-bearing pin 150, which is situated within the central pin-holes (not individually labeled in FIG. 1) of both two-pitch link 102 and two-pitch link 112. Hammer-bearing pin 150 is also slidably received within pin sleeve 152 which is disposed between two-pitch links 102 and 112.

Motorized sprocket assembly 122 includes motor 116 and sprockets 156 and 158, while free sprocket assembly 124 includes sprockets 166 and 168. Chain 101 is operably engaged around sprocket 156 and 166, and chain 111 is operably engaged around sprockets 158 and 168. Sprocket assembly bearing 190, and a corresponding sprocket assembly bearing disposed opposite thereto (obscured from view in FIG. 1), hold sprocket assembly 122 on frame 106. Similar sprocket assembly bearings (not depicted in FIG. 1) are used to hold free sprocket assembly 124 on frame 106.

Hammer implement 172 is slidably received within frame 106. Hammer implement 172 includes impact tool 104, hammer collar 113, and hammer weight 174. Hammer impact tool 104 is described in additional detail with reference to FIG. 6, infra.

In operation, hydraulic lines 138, 140 supply hydraulic power from hydraulic circuit 132 to motor 116 for the powered rotation of sprocket assembly 122. This rotates chains 101, 111 bearing two-pitch links 102, 112, which bear hammer-bearing pin 150. Hammer-bearing pin 150 in turn catches hammer latch 179 and thereby bears the weight of hammer implement 172 as it is lifted to a height, before being dropped, in a repeated process. Hammer latch 179 is fixed to hammer implement 172 and configured to catch hammer pin 150, thereby serving as the field of contact by which hammer pin 150 lifts hammer implement 172 before rotating out from under hammer latch 179 at the top of the range of chains 101 and 111, allowing hammer implement 172 to fall back down through the interior of frame 106.

Hammer-bearing pin 150 is optimized for strong, reliable bearing of hammer implement 172 through repeated cycles of lift and drop. As hammer implement 172 is lifted, its weight is borne by pin 150 very close to the centerline of each of the chains 101, 111. This helps maintain the integrity of chains 101, 111 through extended usage. Two-pitch links 102, 112 and hammer-bearing pin 150 are enabled, through their properties such as the two-pitch arc form of two-pitch links 102, 112, to roll reliably around sprockets 156, 158.

Hammer-bearing pin 150 is spaced similarly to individual chain pins (not labeled) of chains 101, 111; is in a similar position as an individual chain pin of chains 101, 111; and contacts the sprockets 156, 158 in succession with the individual chain pins. Hammer-bearing pin 150 is the same diameter as an individual roller (not labeled) of one of the chains 101, 111 in this embodiment, which contributes to maximizing the size and strength of hammer-bearing pin 150 while also keeping pin 150 close to the centerline of chains 101, 111. Variations on the relative diameter of hammer-bearing pin 150 to the individual rollers can occur in alternative embodiments.

Figure 2:
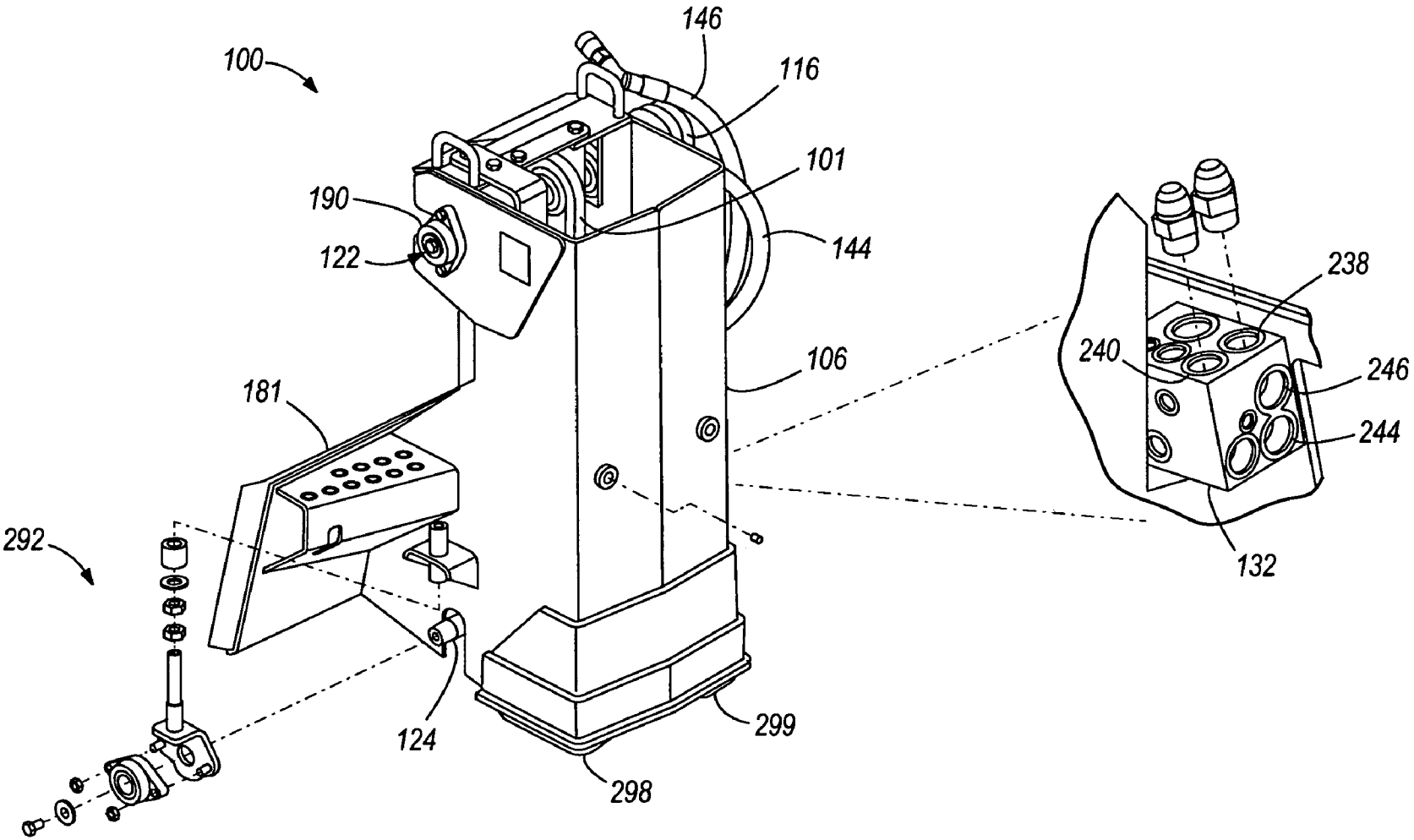
FIG. 2 is another exploded, perspective view of the drop hammer, according to one embodiment.

FIG. 2 is an additional perspective view of drop hammer 100 including chain 101 (and chain 111, which is obscured in this perspective). Motorized sprocket assembly 122 is depicted situated in place upon frame 106 of drop hammer mechanism 100, and rotatably fastened to frame 106 by representative sprocket assembly bearing 190. Additional sprocket assembly bearing 292 is also depicted, in exploded view, showing where it fixes to frame 106 and rotatably fastens free sprocket assembly 124 to frame 106.

Motor 116 of motorized sprocket assembly 122 is coupled to the far side of frame 106. Hydraulic input line 144 and hydraulic return line 146 are also depicted on the far side of frame 106. Hydraulic circuit 132 is depicted in a rotated, partially exploded view, indicating where it couples to frame 106 on a side thereof that is obscured in this perspective. Hydraulic circuit 132 includes input line portal 244 for receiving hydraulic input line 144, and return line portal 246 for receiving hydraulic return line 146. Hydraulic circuit 132 also includes motor line portals 238 and 240 for receiving hydraulic motor lines 138 and 140 (not depicted in FIG. 2).

Attachment plate 181 is again depicted, fixed to frame 106. Skids 298 and 299 are disposed on the underside of frame 106 for supporting drop hammer 100 upon a ground surface.

Figure 3:
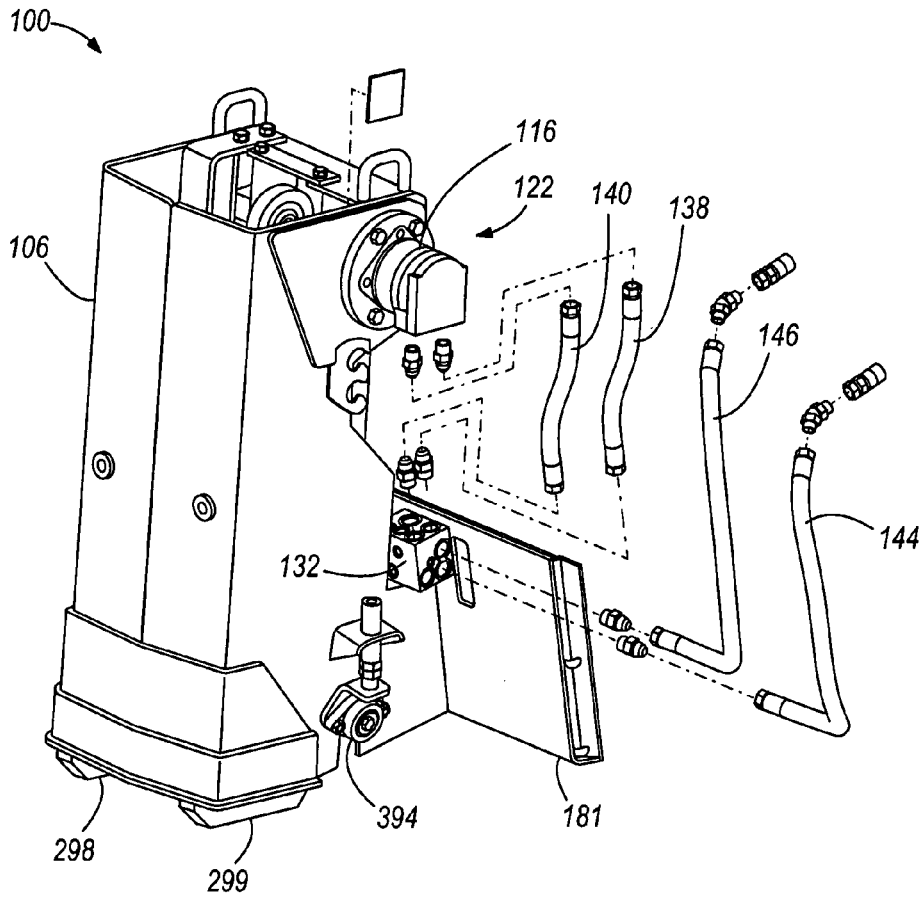
FIG. 3 is another exploded, perspective view of the drop hammer, according to one embodiment.

FIG. 3 is another exploded, perspective view of drop hammer 100, from a third perspective. Motorized sprocket assembly 122 is mounted on frame 106, and includes motor 116. Motor 116 is fluidly coupled to hydraulic motor lines 138 and 140, which lead from hydraulic circuit 132, which in turn is fluidly coupled to hydraulic input line 144 and hydraulic return line 146. Sprocket assembly bearing 394 is also coupled to frame 106 opposite sprocket assembly bearing 292 (not depicted in FIG. 3) rotatably to fasten free sprocket assembly 124 to frame 106. Attachment plate 181 is fixed to frame 106. Skids 298 and 299 are again depicted disposed on the underside of frame 106 for supporting drop hammer 100 upon a ground surface.

Figure 4:
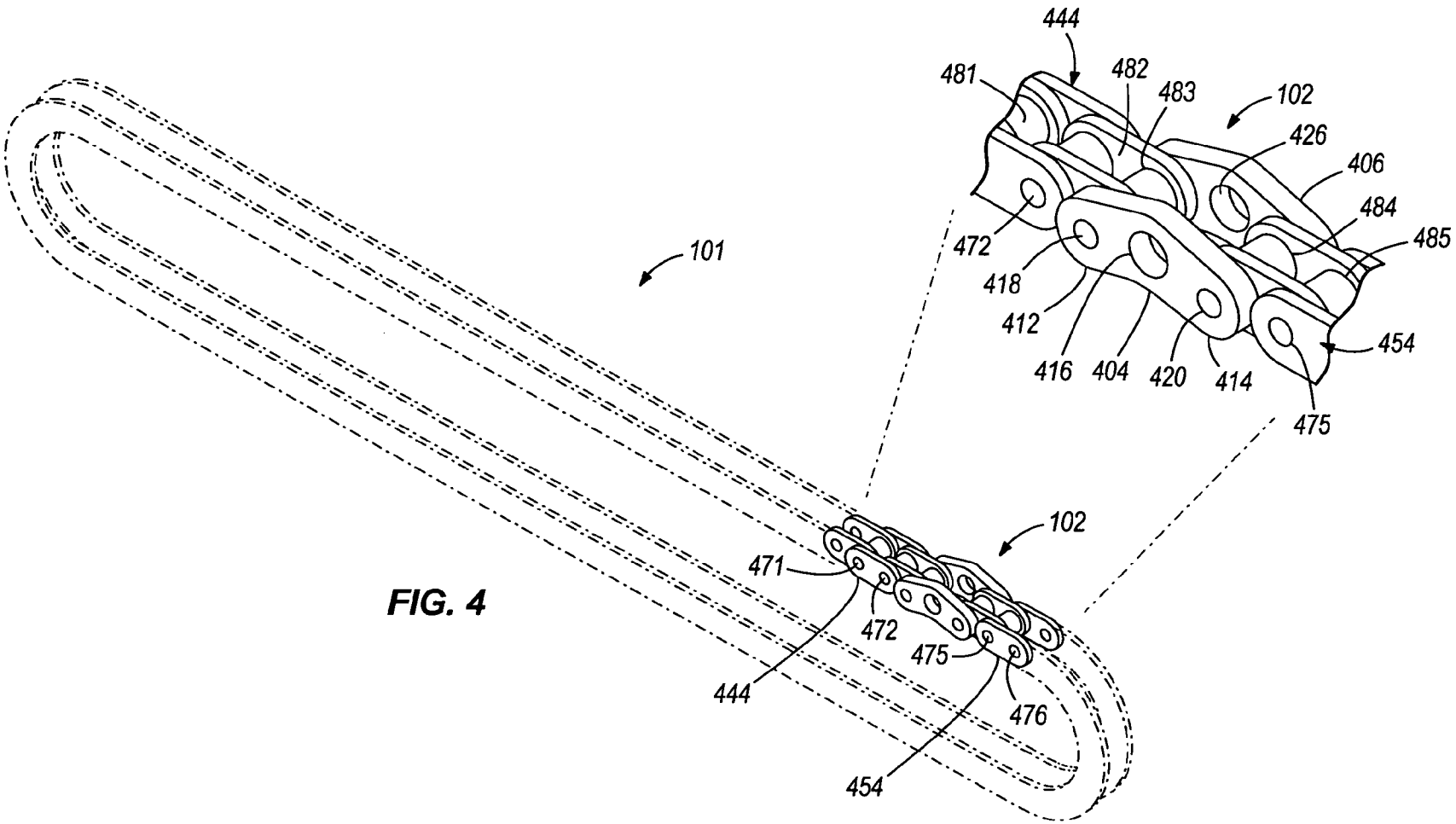
FIG. 4 is a perspective view of a chain including a two-pitch link, belonging to the drop hammer, according to one embodiment.

FIG. 4 is a perspective view of chain 101 of drop hammer 100, and serves as representative of chain 111 (not depicted in FIG. 4) as well. Chain 101 includes two-pitch link 102 amid regular links such as links 444, 454. Regular link 444 includes pin apertures 471, 472, while regular link 454 includes pin apertures 475, 476.

A close-up sectional view is provided surrounding two-pitch link 102, which includes two link plates 404, 406. Representative link plate 404 has a different pitch in each of its two wings 412, 414, and has a hammer pin aperture 416 and two end roller apertures 418, 420. Link plate 406 has corresponding features. Chain rollers 481, 482, 483, 484, 485 connect opposing sides of the link plates of both the regular links such as links 444, 454, and two-pitch link 102.

Hammer pin aperture 416 of link plate 404 and its corresponding pin-hole 426 of link plate 406 are adapted rotatably to engage hammer-bearing pin 150 (not depicted in FIG. 4), that is strong enough to sustain hammer implement 172 (not depicted in FIG. 4) reliably through extended lifting and dropping. At the same time, link plates 404 and 406 maintain the integrity of chain 101 and keep the lifting force for a drop hammer advantageously close to the centerline of chain 101 and of hammer-bearing pin 150 (not depicted in FIG. 4). Chain 111 has features corresponding to those depicted and described herein referring to chain 101.

Figure 5:
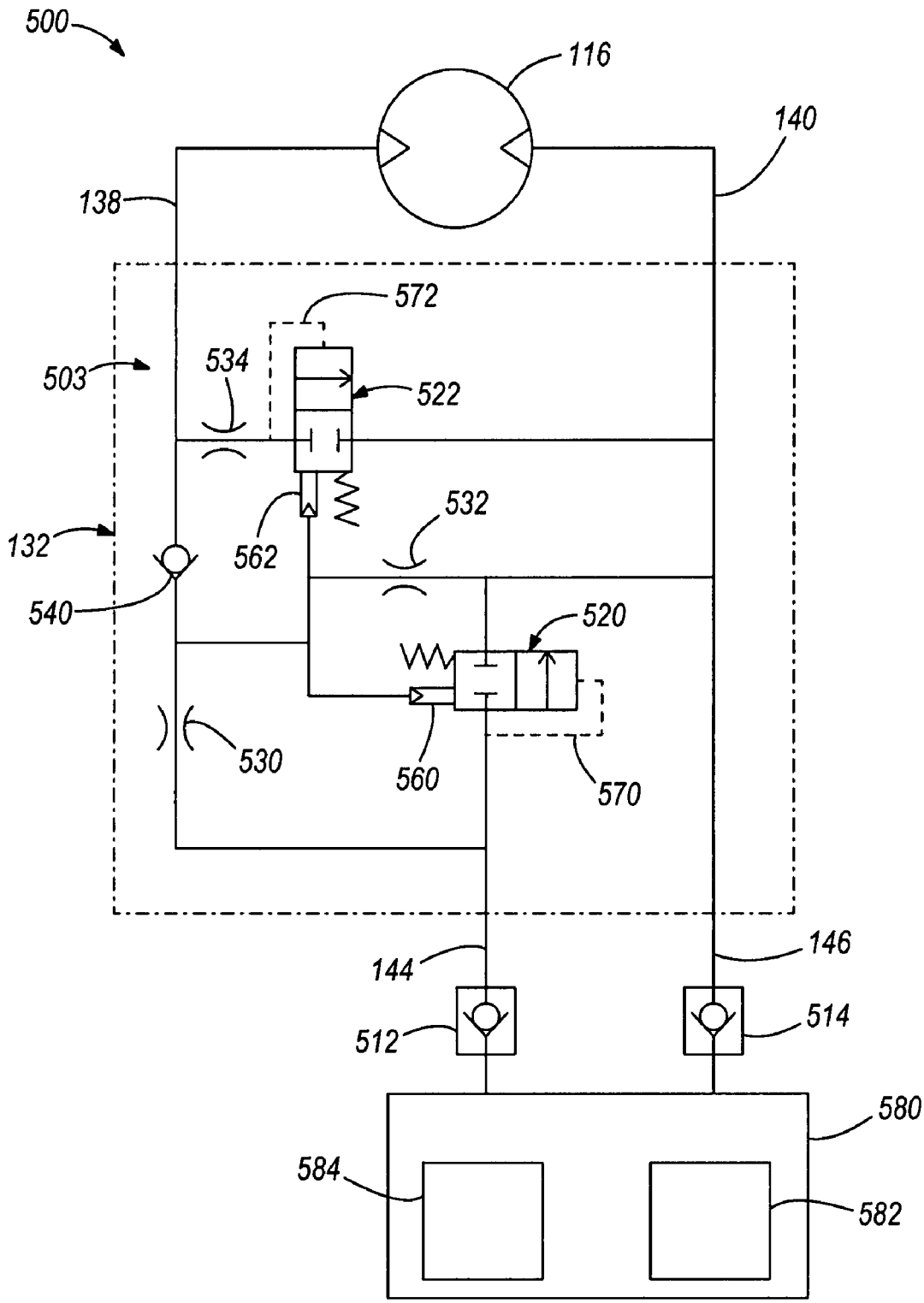
FIG. 5 is a schematic diagram depicting a hydraulic circuit including a slow-release device, belonging to the drop hammer, according to one embodiment.

FIG. 5 is a schematic diagram depicting a hydraulic system 500 including a hydraulic circuit 132 comprising a slow-release device 503, according to one illustrative embodiment. Slow-release device 503 is an inventive feature of hydraulic circuit 132 which enables a drop hammer in which hydraulic circuit 132 is incorporated to release differential pressure selectively, thereby slowly displacing a load, connected to an actuator such as motor 116, as a function of flow from a fluid source, such as hydraulic machine 580. For example, in one embodiment, slow-release device 503 enables the drop hammer in which hydraulic circuit 132 is incorporated to slowly and controllably lower a load, such as hammer implement 172 (not depicted in FIG. 5), even when hydraulic power in the drop hammer is cut off while the load is in an elevated position.

Hydraulic system 500 is depicted in fluid coupling with a hydraulic machine 580 (not integral to this embodiment), such as a loader, to which hydraulic circuit 132 is fluidly coupled. Slow-release device 503 advantageously allows hydraulic fluid to escape slowly from the higher-pressure side of motor 116 if hydraulic flow to the hydraulic circuit 132 is closed while a load such as a hammer implement (not depicted in FIG. 5), controlled by motor 116 is in an elevated position, allowing the load to sink slowly to the ground in a slow, controlled manner.

More particularly, hydraulic system 500 includes hydraulic circuit 132 with fluid circuit lines 144, 146, 138, and 140. Lines 138 and 140 are motor lines, coupled to motor 116. Line 144 is a pump input line, coupled to quick coupler valve 512. Line 146 is a return line, which feeds through quick coupler valve 514. Quick couplers 512 and 514 are fluidly coupled to hydraulic machine 580 (not integral to this embodiment), comprising pump 582 and engine 584. Alternative embodiments of the present invention may include hydraulic machine 580 along with drop hammer 100 as an integral product.

Hydraulic circuit 132 includes internal components depicted in FIG. 5 according to standard hydraulic schematic notation. These include flow control valves 520 and 522, restrictors (or orifices) 530, 532, and 534, and check valve 540, each particularly situated as shown along the internal hydraulic lines within hydraulic circuit 132. Flow control valve 522 and restrictor 534 comprise slow-release device 503.

Flow control valve 520 and large restrictor 530 are fluidly coupled to input line 144. Large restrictor 530 is fluidly coupled to check valve 540, as well as to signal bleed-off orifice 532 and lockout pressure controls 560, 562 of flow control valves 520, 522 respectively. Check valve 540 is fluidly coupled to motor flow line 138, as well as to slow-release restrictor 534.

Flow control valve 520, large restrictor 530, and check valve 540 contribute to assure a selected maximum flow rate of, for example, fifteen gallons per minute to motor 116. A variety of values for the maximum flow rate can be obtained in alternative embodiments, both higher and lower than fifteen gallons per minute. Motor flow lines 138 and 140 are fluidly coupled to opposing sides of motor 116. Motor flow line 140 is also fluidly coupled to flow control valves 520 and 522, and to signal bleed-off orifice 532.

In the event that hydraulic flow from input line 144 stops, for instance if engine 584 is turned off, signal bleed-off orifice 532 bleeds off pressure from the lines bounded by restrictor 530, check valve 540, and lockout pressure controls 560, 562. By bleeding off this pressure, signal bleed-off orifice 532 assures that the pressure external to lockout pressure control 562 drops significantly below the pressure internal to it, i.e. within flow control valve 522. For instance, a forty pound spring may be used for flow control valve 522, so that it will open once the pressure differential is great enough relative to the area loaded by the spring to exert a forty pound force. Springs with other values, or other mechanisms, may also be used in alternative embodiments to accomplish the same purpose.

When the motor 116 is in normal operation, hydraulic fluid flows from hydraulic machine 580 into hydraulic circuit 132 through input line 144. In one illustrative embodiment, up to fifteen gallons per minute, for example, of hydraulic flow passes through large restrictor 530 and check valve 540 in normal operation. Because the output of large restrictor 530 is fluidly coupled to both lockout pressure control 560 of flow control valve 520 and lockout pressure control 562 of flow control valve 522, the hydraulic pressure balances flow control valves 520 and 522, to prevent either of them from shifting inadvertently.

For instance, the pressure at lockout pressure control 562 of flow control valve 522 is kept high enough, during normal operation of motor 116, to prevent flow control valve 522 from opening. For example, both the pressure in motor line 138 and between restrictor 530 and lockout pressure control 562 and associated lines may be 1200 pounds per square inch (psi). No net force is provided to lockout pressure control 562, and flow control valve 522 therefore remains closed. Other values of pressure and pressure differential may be used in alternative embodiments.

More particularly, pilot pressure line 570 is associated with flow control valve 520. In one illustrative embodiment, fifteen gallons per minute flows through large restrictor 530. However, much more than fifteen gallons per minute of hydraulic fluid may be fed by hydraulic machine 580 through input line 144. For instance, a typical large loader contemplated as hydraulic machine 580 may feed up to twenty-five gallons per minute through input line 144. Such excess flow causes sufficient pressure in pilot pressure line 570 to open flow control valve 520, and begin shunting hydraulic flow from input line 144 through flow control valve 520 to return line 146.

This assures proper flow to motor 116 while preventing excess fluid pressure from building up in hydraulic circuit 132, which could otherwise rise to a system release pressure of hydraulic machine 580, such as a loader, to which hydraulic circuit 132 is fluidly coupled via input line 144 and return line 146. For instance, in one embodiment, the present invention is contemplated for operation with a hydraulic machine 580 having a nominal operating pressure of 1,200 pounds per square inch (psi) and a typical system release pressure of 3,000 psi. Operation at pressures approaching the magnitude of the system release pressure can cause undesirable effects, including low efficiency, excess waste heat, and an undesirable "growl" from engine 584 of hydraulic machine 580.

Slow-release device 503 performs advantageously when hydraulic system 500 is shut down, or hydraulic flow to the hydraulic circuit 132 is otherwise closed, while a load such as hammer implement 172 (not depicted in FIG. 5) controlled by motor 116 is still in an elevated position. Higher pressure then causes fluid to bleed through signal bleed-off orifice 532 to trigger lockout pressure control 562 and open flow control valve 522. Before flow control valve 522 opens, fluid remains trapped in motor line 138 at the normal operating pressure, e.g. 1,200 psi, and cannot escape through check valve 540 or flow control valve 522 in its closed state. After flow control valve 522 opens, the fluid in motor line 138 is able to flow through flow control valve 522 and loop back to motor 116 along motor line 140, thereby depressurizing motor line 138.

Slow-release device 503 thereby allows hydraulic fluid to release slowly from the higher-pressure side of motor 116. Modifications of this mechanism occur in alternative embodiments, such as allowing the higher pressure on one side of motor 116 to release via return line 146. By whatever mechanism, slow-release device 503 thereby allows a load controlled by motor 116, such as hammer implement 172 (not depicted in FIG. 5), to sink to the ground in a slow, controlled manner.

The operator may decide to initiate this slow-release function by intentionally shutting off flow to hydraulic circuit 132, or flow into hydraulic circuit 132 may be lost due to accident or operator error, for example. In any case, slow-release device 503 provides for the slow, safe lowering of the load to the ground, despite hydraulic system 500 being unpowered.

In particular, in the event of a loss of flow to motor 116 through motor line 138, fluid pressure on motor line 138 can be higher than on motor line 140. Fluid at motor line 138 may pass through restrictor 534 of slow-release device 503 and into pilot pressure line 572, but may not flow back through check valve 540. However, fluid between restrictor 530 and check valve 540 may drain through signal bleed-off orifice 532, lowering pressure on flow control valves 520 and 522. This fluid is free to flow out of hydraulic circuit 132 through return line 146.

As pressure on flow control valve 522 via lockout pressure control 562 drops, the fluid pressure at fluid control 562 drops below the pressure of the fluid in the hydraulic lines including motor line 138 and pilot pressure line 572. This enables flow control valve 522 to open, unlike during normal operation of motor 116. With flow control valve 522 open, the hydraulic fluid is able to circulate through flow control valve 522 to depressurize by the reverse rotation of the motor 116 due to the load slowly lowering in the frame (not depicted in FIG. 5), in one illustrative embodiment.

Thus, the dimension of restrictor 534 is carefully selected to allow for a moderate, safe, controlled circulation of fluid through motor 116. This in turn provides for the safe, controlled descent of the load such as hammer implement 172 (not depicted in FIG. 5), controlled by motor 116.

Figure 6:
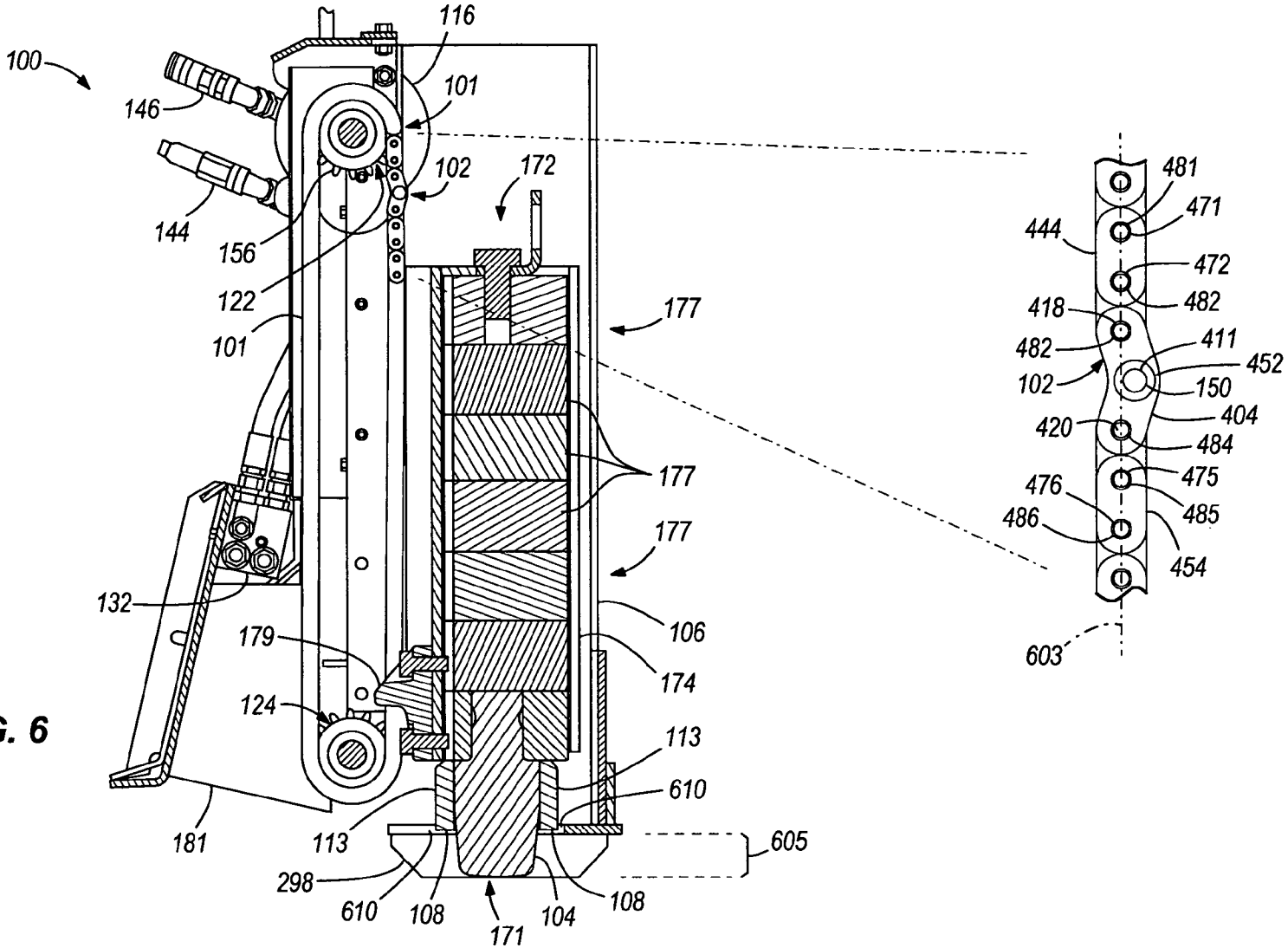
FIG. 6 is an integrated side view of the drop hammer, according to one embodiment.

FIG. 6 depicts an integrated side view of drop hammer 100 including additional detail of hammer implement 172 and chain 101 as integrated into drop hammer 100. Hammer implement 172 is slidably received in frame 174, upon which motorized sprocket assembly 122 and free sprocket assembly 124 are rotatably mounted. Chain 101 is engaged about sprocket assemblies 122 and 124, as is chain 111 (not shown in FIG. 6). Hydraulic circuit 132, hydraulic lines 144 and 146, and attachment plate 181 are mounted on frame 106. Skid 298 is again depicted disposed on the underside of frame 106 for supporting drop hammer 100, along with skid 299 (not shown in FIG. 6), upon a ground surface.

A small section of chain 101 including two-pitch link 102 is depicted in exploded view. Chain 101 includes two-pitch link 102, as well as regular links including links 444, 454. Regular links 444, 454 include pin apertures 471, 472, 475, 476 which rotatably engage chain rollers 481, 482, 485, 486, respectively. Two-pitch link 102 includes pin apertures 418, 420 which rotatably engage chain rollers 483, 484, respectively. Two-pitch link 102 also includes hammer pin aperture 416 for rotatably engaging hammer pin 150. Features discussed herein referring to chain 101 apply similarly to its companion chain 111 (not shown in FIG. 6).

Chain pin sleeve 452 surrounds the portion of hammer pin 150 internal to chain 101, in other words, between chain plates 404 and 406 (depicted in FIG. 4) of two-pitch link 102. Hammer pin 150 extends from chain 101 to chain 111 (not shown in FIG. 6), and serves to catch hammer latch 179 and thereby sustain the weight of hammer implement 172 as hammer implement 172 is lifted. This is aided by the nearness of the weight-bearing hammer pin 150 to the line defined by the positions of the adjacent chain links including links 444, 454, and by the tension provided by chain 101.

For example, if a chain centerline 603 is defined as passing through the centers of each chain roller 481, 482, 483, 484, 485, 486, etc. in their ideal, unloaded positions, centerline 603 also intersects an off-center portion of hammer pin 150, in this illustrative embodiment. Hammer pin aperture 416 and hammer pin 150 thereby have a slight offset from chain centerline 603, as defined by two-pitch links 101 and 111. This offset is to optimize between the combined performance objectives of lifting hammer implement 172 and engaging sprocket assemblies 122 and 124.

Hammer pin 150 is therefore substantially close to being in line with chains 101 and 111 (the latter not depicted in FIG. 6). This helps prevent any significant transverse stress on chains 101 and 111 or net torque on hammer implement 172 during the process of lifting hammer implement 172.

Hammer implement 172 is lifted as motor 116 is turned counterclockwise, as seen in the view of FIG. 6, as motivated by hydraulic flow provided via hydraulic circuit 132. Sprocket assemblies 122 and 124 and chains 101 and 111 (the latter of which is not depicted in FIG. 6) thereby are also turned counterclockwise as seen in the view of FIG. 6. As two-pitch link 102 and hammer pin 150 come up along the right side (as seen in FIG. 6) of motorized sprocket assembly 122, hammer pin 150 is rotated out from under hammer latch 179, allowing hammer implement 172 to drop and impact a ground surface thereunder. Two-pitch link 102 meanwhile rotates counterclockwise around sprocket 156 of sprocket assembly 122, as its chain rollers 483, 484 and chain pin sleeve 452 of hammer pin 150 engage between individual teeth of sprocket 156.

Hammer implement 172 includes a hammer collar 113 as another improved feature of drop hammer 100, according to one embodiment. Hammer collar 113 is disposed around impact tool 104 of hammer implement 172. Hammer implement 172 also includes hammer weight 174 and hammer latch 179, as described supra. Hammer weight 174 includes individual weights 177 stacked within it. Individual weights 177 are easily capable of being removed, added, and interchanged, in this embodiment. This may provide advantages in tailoring the weight of hammer implement 172 for specific targets (not depicted).

Drop hammer 100 is often used for a variety of different concrete demolishing applications. When drop hammer 100 is used in more delicate applications, for instance, on a typical concrete sidewalk (not depicted) with a thickness of only three to four inches, hammer implement 172 can be easily capable of blasting through the sidewalk. Preventing more extensive demolishing of the concrete than intended may then become a significant issue. A delicate target of demolition also risks allowing the hammer implement 172 to act in an uncontrolled manner, such as to rebound unpredictably, or to penetrate the concrete too deeply such that hammer implement 172 would strike a bottom plate 610 of frame 106.

Hammer collar 113 helps fulfill the need for precision in demolishing, and prevents hammer implement 172 from uncontrolled impacts on the target (not depicted) or frame 106. Hammer collar 113 fits around impact tool 104 of hammer implement 172, admitting only a small projection 605, such as a few inches, of impact tool 104 beyond the extent of hammer collar 113. Hammer collar 113 is welded onto impact tool 104, in this embodiment. Other modes of attachment of hammer collar 113 to impact tool 104 are used in alternative embodiments.

Hammer collar 113 has a broad, flat surface 108 facing the impact direction 171. If the target of demolition is relatively delicate, sufficient for the small projection 605 of impact tool 104 to penetrate it completely while hammer implement 172 still has significant downward momentum, flat surface 108 of hammer collar 113 impacts the periphery of the target of demolition (not depicted) and absorbs much of the excess momentum of hammer implement 172. This dissipates the excess momentum relatively benignly for the peripheral area of the target, and without the hammer implement 172 striking frame 106.

Although the present invention has been described with reference to illustrative embodiments, workers skilled in the art will recognize that changes may be made in form and detail without departing from the spirit and scope of the invention. For example, while certain specific embodiments are described and depicted to help illustrate the invention, many other embodiments are also included within the metes and bounds of the invention.

As a particular example, drop hammers configured for attachment to loaders are particularly described and depicted as illustrative of the present invention. However, a great variety of alternative embodiments of drop hammers are also contemplated, which would be similarly advantaged by inclusion of the particular improved features described and depicted herein, such as the two-pitch link, the slow-release device, and the hammer collar.

In addition, many other embodiments are contemplated, including those that are defined by the doctrines of equivalence or differentiation to the specific embodiments described and depicted herein. Those who are competent in the fields of drop hammers or hydraulic systems will begin to recognize the variety of the embodiments encompassed by the present disclosure.

What is claimed is:

1. A drop hammer comprising:

a load;

a chain comprising a two-pitch link disposed to selectively suspend the load, the two-pitch link comprising two wings with a different pitch relative to each other, and a catch disposed between the two wings at an offset from a centerline of the chain, said centerline being defined as a line passing through the centers of chain rollers comprised in the chain, the catch being configured for selectively suspending the load;

an actuator disposed in rotatable engagement with the chain; and a fluid circuit, connected to the actuator and connectable to a fluid source, the fluid circuit being operable with differential pressure to displace the load, the fluid circuit comprising a slow-release device configured to release differential pressure when hydraulic power to the fluid circuit is cut off, thereby enabling the load to be displaced at a restricted rate.

2. The drop hammer of claim 1, wherein the slow-release device comprises a restrictor and a flow control valve.

3. The drop hammer of claim 2, wherein the flow control valve is disposed downstream of the restrictor.

4. The drop hammer of claim 2, wherein the flow control valve is configured to remain closed when the fluid source provides a flow.

5. The drop hammer of claim 1, wherein the fluid circuit further comprises a signaling restrictor that responds to a sufficiently low flow from the fluid source by activating the slow-release device.

6. The drop hammer of claim 5, wherein the slow-release device comprises a flow control valve, and the signaling restrictor activates the slow-release device by opening the flow control valve responsively to the sufficiently low flow from the fluid source.

7. The drop hammer of claim 1, wherein the actuator comprises a motor, and a the chain is powered by the motor.

8. The drop hammer of claim 1, wherein the load comprises a hammer implement.

9. The drop hammer of claim 1, wherein the fluid source provides hydraulic power.

10. The drop hammer of claim 1, wherein the fluid circuit further comprises a check valve disposed between the fluid source and the slow-release device.

11. The drop hammer of claim 1, wherein the fluid circuit further comprises a second flow control valve between the fluid source and the slow-release device, the second flow control valve configured for bypassing excess fluid from the fluid source.

12. The drop hammer of claim 1, wherein the slow-release device comprises a restrictor and a first flow control valve, and wherein the fluid circuit is connectable to the fluid source via an input, and the fluid circuit further comprises:

a second flow control valve coupled to the input;

a check valve between the input and the slow-release device; and a signaling restrictor, coupled to the input, that responds to a sufficiently low flow from the fluid source by opening the flow control valve comprised in the slow-release device.

13. A drop hammer comprising:

a frame;

a selectively actuated rotatable sprocket, mounted on the frame;

a hammer implement; and a chain, engaged by the sprocket, the chain comprising a two-pitch link and a plurality of parallel chain rollers, the two-pitch link comprising two wings with a different pitch relative to each other, and a catch disposed between the two wings, at an offset from a centerline of the chain, wherein said centerline is defined as a line passing through the centers of the chain rollers, the catch being configured for engaging the hammer implement, enabling the chain to displace the hammer implement.

14. The drop hammer of claim 13 further comprising a second chain that comprises a second two-pitch link, having two wings with a different pitch relative to each other, wherein the catch is further disposed on the second two-pitch link, at an offset from a centerline of the second chain.

15. The drop hammer of claim 13, wherein the catch comprises a pin.

16. The drop hammer of claim 13, wherein the hammer implement comprises a hammer latch configured for engaging the catch on the two-pitch link.

17. The drop hammer of claim 13, wherein the two-pitch link is configured to roll engagingly around the sprocket and thereby release the hammer implement.

18. A drop hammer comprising:

a frame;

a selectively actuated rotatable sprocket, mounted on the frame;

a chain coupled to the sprocket, the chain comprising a two-pitch link, the two-pitch link comprising two wings and a catch disposed between the wings, the wings having a different pitch relative to each other; and a selectively actuated hammer implement, displaceably mounted on the frame and selectively actuated by engagement with the catch of the two-pitch link, the hammer implement comprising:

an impact tool; and a collar surrounding the impact tool.

19. The drop hammer of claim 18, wherein the collar is surroundingly attached to the impact tool in an annular ring, and comprises a substantially flat surface facing in a direction of an impact surface of the impact tool.

20. The drop hammer of claim 18, wherein the collar is surroundingly attached to the impact tool such that a limited portion of the impact tool projects beyond the collar.

* * * * *